US011384487B2

(12) United States Patent
Schroeder

(10) Patent No.: US 11,384,487 B2
(45) Date of Patent: Jul. 12, 2022

(54) PAVER AND PAVEMENT MADE THEREFROM

(71) Applicant: Detlef Schroeder, Aachen (DE)

(72) Inventor: Detlef Schroeder, Aachen (DE)

( * ) Notice: Subject to any disclaimer, the term of this patent is extended or adjusted under 35 U.S.C. 154(b) by 7 days.

(21) Appl. No.: 17/261,816

(22) PCT Filed: Jul. 23, 2019

(86) PCT No.: PCT/DE2019/000197

§ 371 (c)(1),
(2) Date: Jan. 25, 2021

(87) PCT Pub. No.: WO2020/025073

PCT Pub. Date: Feb. 6, 2020

(65) Prior Publication Data

US 2021/0269987 A1 Sep. 2, 2021

(30) Foreign Application Priority Data

Aug. 1, 2018 (DE) ..... 10 2018 006 064.1

(51) Int. Cl.
*E01C 5/00* (2006.01)

(52) U.S. Cl.
CPC ..... *E01C 5/00* (2013.01); *E01C 2201/02* (2013.01)

(58) Field of Classification Search
CPC ..... E01C 2201/02; E01C 2201/12
USPC ..... 404/37–39; D25/113
See application file for complete search history.

(56) References Cited

U.S. PATENT DOCUMENTS 3,873,225 A * 3/1975 Jakobsen ..... E01C 5/00 52/591.1
D317,207 S * 5/1991 Scheiwiller ..... D25/113
D317,208 S * 5/1991 Scheiwiller ..... D25/113
5,503,498 A * 4/1996 Scheiwiller ..... E01C 5/00 52/603
D434,857 S * 12/2000 Scheiwiller ..... D25/113
6,863,469 B2 * 3/2005 Bolduc ..... E01C 5/06 404/34
8,696,235 B2 * 4/2014 Ciccarello ..... E01C 11/225 52/603
9,163,363 B2 * 10/2015 Karau ..... E01C 5/00
D896,997 S * 9/2020 von Langsdorff ..... D25/113

(Continued)

FOREIGN PATENT DOCUMENTS

CA 2484584 A1 * 5/2006 ..... E01C 5/06
DE 202006013475 U 12/2006

(Continued)

*Primary Examiner* — Thomas B Will
*Assistant Examiner* — Katherine J Chu
(74) *Attorney, Agent, or Firm* — Andrew Wilford

(57) ABSTRACT

The invention relates to a paving stone (1) and to a paving produced using same. A strip-shaped connection section (4) is provided at least on one lateral face of the paving stone, which vertically projects from same and interacts with strip-shaped connection sections of adjoining stones in the course of producing a paving and establishing a connection. The connection section (4) has a stepped shape with at least three graduated shoulders one over another. This both achieves a joint that expands in the upward direction, and prevents the pointing from loosening or being cast upward when forces act upon the paving, for example when subject to vibrations.

14 Claims, 2 Drawing Sheets

(56) References Cited

U.S. PATENT DOCUMENTS

| | | | | |
|---|---|---|---|---|
| 2014/0199121 | A1* | 7/2014 | Brunkhorst | E01C 5/00 404/73 |
| 2016/0097168 | A1* | 4/2016 | Karau | E01C 5/00 404/38 |
| 2017/0022710 | A1* | 1/2017 | Riccobene | E02D 29/0266 |

FOREIGN PATENT DOCUMENTS

| | | | | |
|---|---|---|---|---|
| DE | 102005057434 | A1 * | 5/2007 | E01C 5/06 |
| DE | 102001015831 | A | 10/2007 | |
| DE | 102007046238 | A1 * | 4/2009 | E01C 9/005 |
| DE | 102007054564 | A | 5/2009 | |
| DE | 102009017511 | A1 * | 10/2010 | E01C 5/06 |
| DE | 202013003983 | U1 * | 7/2013 | E01C 5/06 |
| DE | 102013007338 | A1 * | 10/2014 | E01C 5/06 |
| DE | 202016002893 | U1 * | 7/2016 | |
| DE | 102017009020 | A1 * | 3/2019 | |
| EP | 1036882 | A | 3/1999 | |
| EP | 1335069 | A | 8/2003 | |
| EP | 1335069 | A2 * | 8/2003 | E01C 5/00 |
| EP | 1624108 | A1 * | 2/2006 | E01C 5/00 |
| EP | 1862594 | A1 * | 12/2007 | E01C 5/06 |
| EP | 2218822 | A2 * | 8/2010 | B28B 15/005 |
| EP | 2966223 | A1 * | 1/2016 | E01C 5/00 |

* cited by examiner

PAVER AND PAVEMENT MADE THEREFROM

CROSS REFERENCE TO RELATED APPLICATIONS

This application is the US-national stage of PCT application PCT/DE2019/000197 filed 23 Jul. 2019 and claiming the priority of German patent application 102018006064.1 itself filed 1 Aug. 2018.

The present invention relates to a paver with a bottom face, a top face, and a plurality of side faces, at least one of the side faces being formed with outwardly projecting vertical connector ridges that, during laying of pavement, connect with connector ridges of neighboring pavers to prevent relative displacement.

The present invention relates to a paver having variously shaped side faces, for example flat or curved side faces. When laying pavement by assembling a plurality pavers together, the connector ridges of the pavers fit together like gears or racks. In addition, such connector ridges prevent relative shifting of the pavers and therefore an facilitate laying.

EP 1 335 069 describes a manufactured paver for making pavement and having connector ridges that are widened at the lower end and taper upward. The wide bases are intended to help the pavers to be laid together. DE 20 2006 013 475 also describes a paver with connector ridges and lower plinth-shaped extensions. Also these base extensions serve as a laying aid and are intended to protect the pavers, when exposed to high traffic loads, from exerting high surface pressures on the connector ridges.

EP 1 036 882 describes a manufactured paver for pavement whose side faces carry that maintain side faces of adjacent spacers at a small spacing that is so small that it is the ideal position of the paver with the desired joint width, but, when vibrated, the laid pavement is destroyed. In this way, if the target joint spacing is strictly adhered to, the desired elasticity of the laid pavement is ensured. The spacer should be on the lower areas of connector ridges, so that a shoulder results.

In general, it should be noted with such pavers that an effective protection against displacement of the pavers relative to each other with the help of provided connector ridges requires perfect joint filling. In this case, however, the usually narrow joints are filled from the top with joint material with the result that the respective joint does is not properly filled. In order to prevent this, one already has connector ridges like this designed so that they taper steadily from bottom to top, as for example is the case in EP 1 335 069 mentioned above. However, this configuration has the following disadvantage:

If the pavement is vibrated by traffic, gravity compacts the joint filling. The inclined side wall of the upwardly tapering connector ridges create perpendicular forces against the inclined side walls, that is forces directed obliquely upward, opposite gravity. The forces tend to loosen the joint filling instead of compressing it and to push it up out of the joint that widens obliquely upward. Anyway, this loosening of the joint material, works against the compaction from vibration.

The object of the present invention is to provide a paver of the type described, that ensures particularly good fixation joint filling in the laid pavement.

According to the invention, this object is achieved in a paver of the specified type in that the connector ridge has a stepped shape with at least three ridge sections separated by shoulders and projecting less and less from bottom to top.

The solution according to the invention therefore is a stepped shape of the connector ridge or the connector ridge sections. This ensures that the widening of the corresponding joint upward is not along a steep angle, but takes place like a staircase, so that forces acting on the paver, in particular forces during vibration of the pavement by traffic, are not applied at an angle upward, but are essentially oriented horizontally. These horizontal forces have no loosening effect urging the joint material upward or reduce such forces, so that a better compression of the joint filling can essentially be assumed.

The shoulders preferably extend completely around the connector ridges, from the side face of the paver on one side of the ridge to the side face on the other side, so that there are no corresponding inclined surfaces anywhere on the connector ridges with the disadvantages outlined above. The connector ridge is therefore exposed at at least three vertically extending connector ridge sections one above the other, which are separated from one another by shoulders.

The invention provides no restriction on the number of shoulders. For example, apart from the upper end face of the connector ridge, there can be two or three shoulders. It is important that the connector ridge has a step-like gradation, which has the effect that when force is applied to the paver no upwardly inclined, but horizontally acting force components arise that would loosen or eject of the joint filling.

The width of the respective shoulders can be the same or different, depending according to the design of the connector ridges, which thereby project more or less.

A special embodiment of the invention is characterized in that, from the side face to the outer edge of the connector ridge, the shoulders are inclined downward, in particular at an inclined angle of more than 30°. These sloping shoulders reinforce the effect that the joint filling can slide down, so that compaction is favored. The force components that arise obliquely upward due to the small width of the shoulders can be neglected.

The upper end face of the connector ridge is also preferably angled downward toward the lower end of the connector ridge. In particular, it runs preferentially parallel to the inclined step-shaped shoulders.

The connector ridge can extend over the entire height of a paver, that is extend the bottom face to the top face. The connector ridge preferably extends however only over part of the height of a paver and preferably ends shortly below the top face. When the joint is filled with joint material, the connector ridge not visible. This looks nice and also ensures more joint filling material can be provided or better rainwater infiltration is achieved.

As far as the shape of the connector ridge is concerned, it is designed as a vertical bar is preferably semicircular in horizontal section, with a shape that is semicircular or trapezoidal with an semicircular base being particularly advantageous. These rounded or inclined shapes have the effect that the joint material can slide along the connector ridge and not get caught on it. The corresponding sliding effect is then particularly pronounced when there is a connector ridge section between the step-shaped sections shoulders or several areas with their side parts on the side faces of the cling to the paver, that is gradually pass into this. This is particularly preferred at the lowest connector ridge section.

In a special embodiment, the connector ridge has at its outermost edge a vertical elongated depression. Such a recess can, for example, be a groove. The reason for having such a recess or groove is the following:

The most important area when packing the joint filling is the small zone between the outermost edge or the apex of the connector ridges and the side face of the corresponding neighboring paver. If the joint in between is not perfectly filled, the empty space or in case of vibrations from traffic the joint material (buffer material) ejected from the upper paver area important for buffering from the buffering zone between neighboring pavers paver surface and the outermost edge or the apex in the case of a rounded design of the connector ridge is pushed away to the side. Packing the joint may not work at all. To prevent this, the invention provides a corresponding vertical recess, in which can collect joint filling and counteract any lateral displacement. Such a central vertical groove at the apex of the connector ridge therefore fixes the joint filling in the most important area for buffering. That way, extra packing is significantly improved in the most critical area.

The invention also relates to paving made of an array of pavers of the above described type.

The invention is explained below with reference to embodiments shown in the drawing. Therein:

FIG. 1 an isometric view of four pavers placed next to one another;

Figure 1:
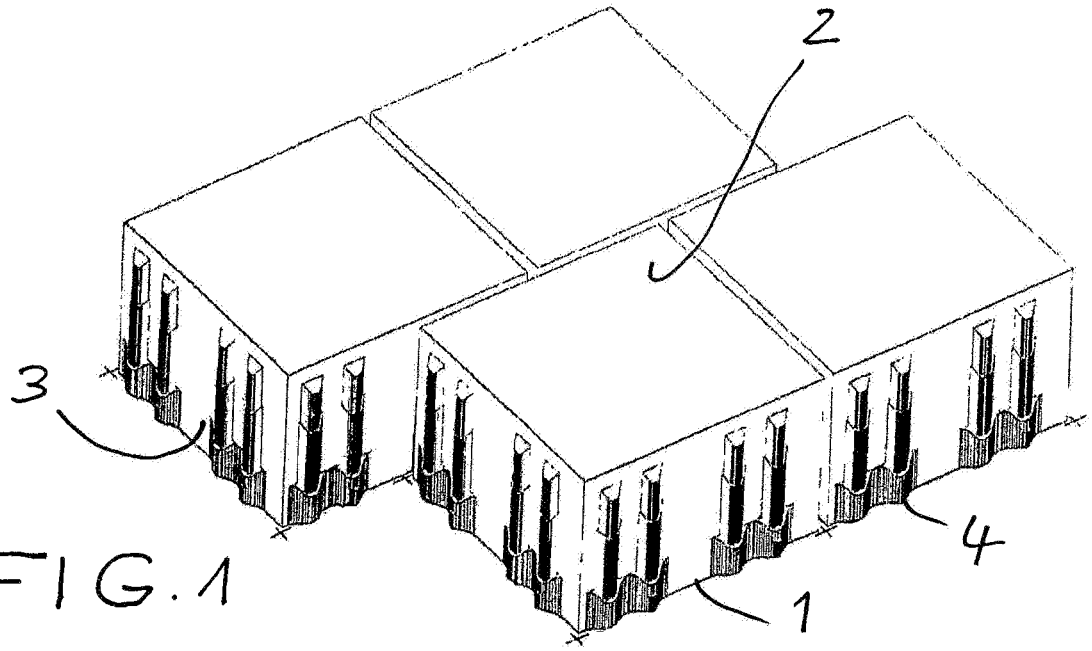

FIG. 1 shows four pavers 1, each of which is rectangular in horizontal section. The pavers 1 each have a bottom face, a top face 2 and four side faces 3. Each side face is provided with two pairs of connector ridges 4. Each connector ridge is in the form as a vertical bar projecting outwardly from the respective side face 3 from the bottom face of the respective paver 1 extends upward to just below the top face 2. In horizontal section each connector ridge 4 has approximately the shape of a trapezoid with a semicircular lateral outer side.

The pairs of connector ridges 4 are so spaced from one another that they fit with the pairs of connector ridges of adjacent pavers to form a pavement bond. When the pavers are fitted together, the connector ridges of adjacent pavers fit to form a joint gap extending from the bottom face to the top face and of increasing with going upward.

Figure 2:
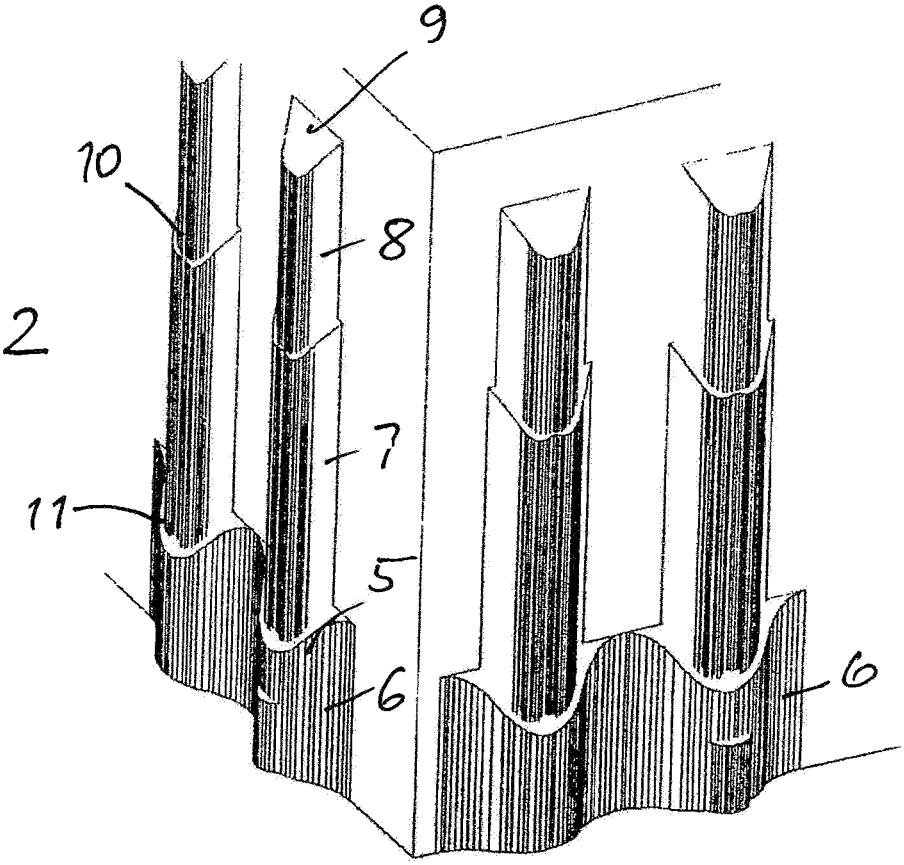
FIG. 2 is a large-scale view of a section of a paver of FIG. 1.

The exact shape of a connector ridge 4 is shown in FIG. 2. The connector ridge 4 shown here is stepped and has from bottom to top three distinct connector ridge sections 5, 7 and 8 delimited by shoulders 11 and 10. Each connector ridge has an upper end face 9. Planes of the shoulders 11, 10 and the upper faces 9 extend downward from and are angled outward at more than 30° from the respective side faces of the respective pavers.

Due to the stepped formation of each connector ridge 4, its three stacked connector sections 5, 7 and 8 extend vertically. Each connector ridge section 5, 7 and 8 therefore projects less and less than the immediately underlying section from the bottom upward on the respective side faces, so that a corresponding joint-gap flare results. A uniform upwardly tapering shape of the connector ridge is therefore avoided. This has the advantage that forces act perpendicular to the surface of the connector ridge, for example when the pavement is vibrated, in the horizontal direction and have no diagonally upward vector effective on the joint filling between adjacent connector ridges and thus there is essentially no loosening of the inserted joint material or ejection of same upward. Compression of the joint material is therefore essentially not reduced.

In the embodiment of a connector ridge 4 as shown in FIG. 2, the lowest and most projecting connector ridge section 5 is formed so that its side parts 6 extend laterally and merge with those of the adjacent paver. In this way, the joint material is prevented from getting stuck.

Figure 3:
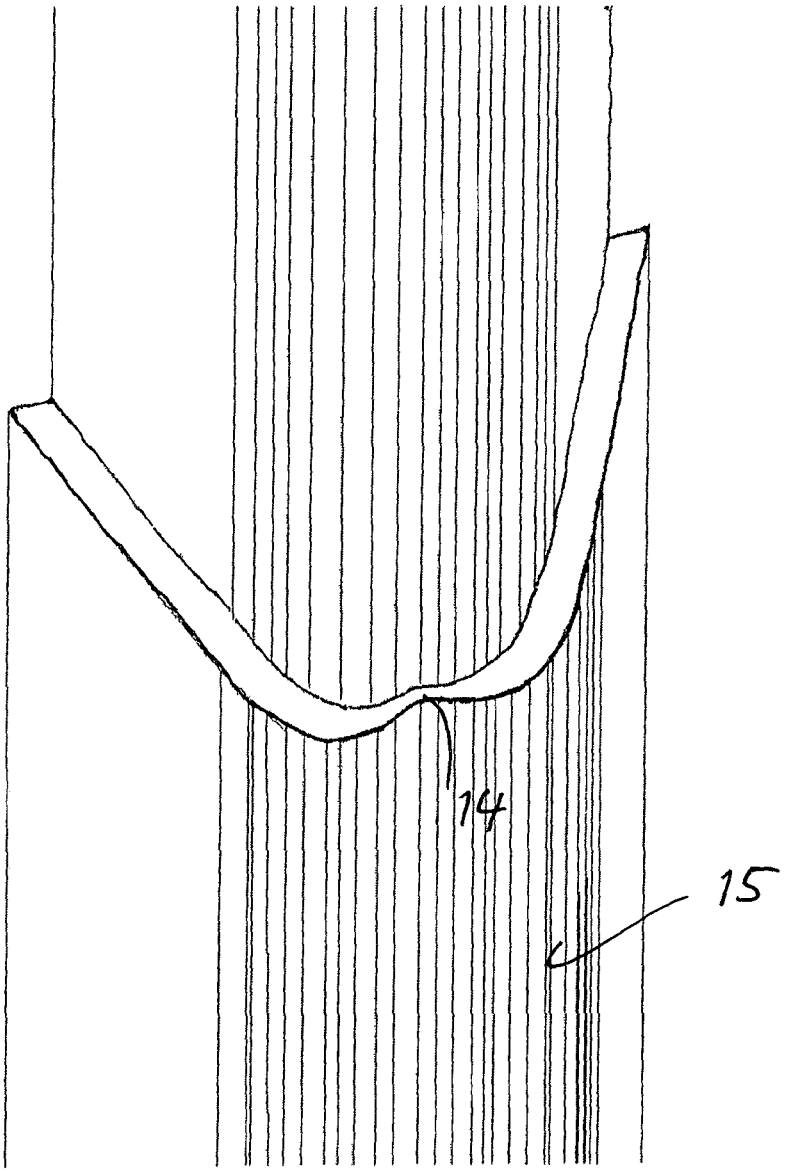
FIG. 3 is an enlarged view of part of a connector ridge.

In the embodiment of a connector ridge 15 as better shown in FIG. 3 its outermost edge or apex is formed with a recess or groove 14 extending longitudinally of the connector ridge to prevent lateral displacement of joint material between the outermost edge of the connector ridge 15 and the side face of the adjacent paver, for example from vibration, so that the corresponding buffer effect is not lost. The recess or groove 14 holds joint material at this point and also ensures a corresponding buffer effect here.

Instead of a depression or groove 14, a corresponding flattening in the outermost edge of the connector ridge can be provided at this point to inhibit lateral displacement of joint material. Such a flattening is shown in FIG. 2.

The invention claimed is:

1. A paver having a bottom face, a top face and a plurality of side faces from at least one of which outwardly projects at least one vertical connector ridge that in laying of pavement fits with connector ridges of neighboring pavers, the at least one connector ridge each having a stepped shape with at least three ridge sections separated by step-like shoulders and in a row, the connector ridge sections separated from one another by the shoulders projecting horizontally from the respective side surfaces less and less from the bottom face to the top face.

2. The paver according to claim 1, wherein the shoulders extend completely around each of the respective at least one connector ridge.

3. The paver according to claim 1, wherein all of shoulders are of the same width.

4. The paver according to claim 1, wherein the shoulders extend downward and are angled outward at more than 30° from the respective side face of the respective paver.

5. The paver according to claim 4, wherein an upper face of each of the at least one connector ridge extends similarly downward and is angled outward at an angle of more than 30° from the respective side face of the respective paver.

6. The paver according to claim 1, wherein each of the at least one connector ridge only extends over part of a height of the respective paver.

7. The paver according to claim 1, wherein each of the at least one connector ridge is generally semicircular in horizontal section or is formed as a trapezoid with a part-circular lateral outer side.

8. The paver according to claim 1, wherein the lowermost connector ridge section is formed with side parts that merge into the respective side face of the paver with side parts of an adjacent paver.

9. The paver according to claim 1, wherein there is on each side face a pair of the at least one connector ridges.

10. The paver according to claim 1, wherein each of the at last one connector ridge has a vertical, elongated depression in its outermost edge.

11. The paver according to claim 1, wherein the at least one connector ridge is arranged in groups of three.

12. The paver according to claim 1, wherein the at least one connector ridge is arranged in groups of two separated by a space.

13. Pavement formed by a plurality of the pavers of claim 1.

14. The paver according to claim 1, wherein each ridge section is of constant cross-sectional shape and size from its upper end to its lower end.

* * * * *